United States Patent [19]

Novomeisky et al.

[11] 4,039,328

[45] Aug. 2, 1977

[54] STEEL

[76] Inventors: Jury Donatovich Novomeisky, ulitsa Nakhimova 86, kv. 48, Tomsk; Mikhail Mikhailovich Eger, ulitsa Oktyabrskaya, 151, kv. 1; Nikolai Petrovich Kravtsov, ulitsa Kalinina, 16, kv. 70, both of Altaisky krai, Rubtsovsk, all of U.S.S.R.

[21] Appl. No.: 603,255

[22] Filed: Aug. 11, 1975

[51] Int. Cl.[2] ..... C22C 38/26; C22C 38/32; C22C 38/38

[52] U.S. Cl. ..... 75/126 B; 75/126 F; 75/126 P

[58] Field of Search ..... 75/126 B, 126 F, 126 P

[56] References Cited

U.S. PATENT DOCUMENTS 3,065,069 11/1962 Manganello ..... 75/126 F

FOREIGN PATENT DOCUMENTS 1,310,183 3/1971 United Kingdom ..... 75/126 B

*Primary Examiner*—Arthur J. Steiner

*Attorney, Agent, or Firm*—Lackenbach, Lilling & Siegel

[57] ABSTRACT

A high strength steel, useful in the manufacture of power bucket teeth, track links for tracked vehicles, frogs, working members of crushers and other mechanical components exposed in service to heavy loads, high - speed wear and subzero temperatures, consisting essentially of 0.8–1.5% C, 9–25% Mn, 0.3–1.2% Si, 0.8–4% Cr, 0.06–0.25% Nb, 0.001–0.01% B, up to 0.05% S, up to 0.1% P and the balance, iron, said steel being capable of being hardened at temperatures of 1080° C and less.

1 Claim, No Drawings

STEEL

The present invention relates to metallurgy of frost-resistant steels and more particularly to steels, comprising carbon, manganese, silicon, chromium, niobium, boron, iron and such impurities as sulphur and phosphorus.

The steel of the present invention is used most advantageously in connection with the manufacture of, for example, power bucket teeth, track links for tracked vehicles, frogs, working members of crushers and other elements, parts or mechanical components exposed in service to heavy loads, high-speed wear and subzero temperatures.

British Pat. No. 1127147 teaches a steel, comprising carbon, manganese, vanadium, chromium, iron and such impurities as sulphur and phosphorus, the weight percentage of said components being as follows:

| | |
|---|---|
| carbon, | 0.4 – 0.6 |
| manganese, | 16.5 – 20.5 |
| vanadium, | 0.25 – 1 |
| chromium, | 3.5 – 6, |

the weight percentage of the impurities being limited to: sulphur, up to 0.015, phosphorus, up to 0.07, silicon, up to 1, and iron, the balance.

The above-specified composition of this steel stipulates a fine-grained structure and sufficiently good physicomechanical properties.

However, said steel does not exhibit sufficient ductility since it contains a considerable amount of carbide-stabilizers (vanadium, chromium).

Attempts at increasing the ductility by reducing the carbon content caused a deterioration of strength and wear resistance.

Moreover, vanadium, chromium and manganese used in the above-specified amounts increased steel cost since they involved higher expenses for materials and more complicated heat-treatment, namely, higher temperatures and prolonged heating in hardening.

British Pat. No. 1148258 teaches a steel, comprising carbon, manganese, chromium, silicon, vanadium, iron and such impurities as sulphur and phosphorus, the weight percentage of said components being as follows:

| | |
|---|---|
| carbon, | 0.9 – 1.4 |
| manganese, | 10.5 – 14 |
| chromium, | 1 – 2 |
| silicon, | 0.15 – 0.7 |
| vanadium, | 0.25 – 1.5, |

the weight percentage of the impurities being limited to: sulphur, up to 0.04, phosphorus, up to 0.04 and iron, the balance.

Carbon, manganese and silicon contents of this steel ensure a higher strength and wear resistance as compared with the above-described steel grades.

However, the presence of such carbide-stabilizers as vanadium and chromium diminishes the ductility of said steel.

Moreover, this steel requires high temperatures of about 1200° C for hardening.

At present an extensive application has steel (see, e.g., Inventor's Certificate of the USSR No. 193080) containing carbon, manganese, silicon, chromium, niobium, iron as well as such impurities as sulphur and phosphorus, the weight percentage of said components being as follows:

| | |
|---|---|
| carbon, | 0.9 – 1.5 |
| manganese, | 9 – 15 |
| silicon, | 0.3 – 1 |
| chromium, | 2 – 3 |
| niobium, | 0.08 – 0.12, |

the weight percentage of the impurities being limited to: sulphur, up to 0.05, phosphorus, up to 0.01, and iron, the balance.

Niobium stipulates a fine-grained structure of this steel, enhances structural and concentration homogeneity and ensures better strength as compared with the preceding steel grade.

In the presence of niobium chromium contributes to better ductility at room and sub-zero temperatures.

However, hardening requires a temperature of about 1150° C, this resulting in considerable power input and fuel consumption.

The principal object of the invention is to provide steel having a lower hardening temperature than the known steel grades.

Another no less important object of the invention is the provision of steel featuring high frost resistance.

Still another object of the invention is to provide steel exhibiting high strength, wear resistance and thermal stability during casting.

These and other objects of the invention are achieved by providing steel comprising carbon, manganese, silicon, chromium, niobium, iron as well as such impurities as sulphur and phosphorus, whose composition, according to the invention, apart from said components taken in the following percentage:

| | |
|---|---|
| carbon, | 0.8 – 1.5 |
| manganese, | 9 – 25 |
| silicon, | 0.3 – 1.2 |
| chromium, | 0.8 –4 |
| niobium, | 0.06 – 0.25, |

incorporates boron whose weight percentage ranges from 0.001 to 0.01, the weight percentage of the impurities being limited to: sulphur, up to 0.05, phosphorus, up to 0.01, and iron, the balance.

The above-specified carbon and manganese contents ensure an austenitic structure after heat-treatment. Further decrease in carbon contents below the lower limit diminishes materially both the strength and wear-resisting properties of steel, whereas an increase in their contents above the upper maximum limit has an adverse effect on ductility.

When the silicon content is less than the lower limit, steel fluidity decreases, whereas an increase in its content above the upper limit causes hot cracking.

A reduction in manganese contents below the lower limit results in ferrite appearing in steel structure.

Manganese, chromium and niobium contents exceeding the above-specified percentage deteriorate ductility and increase the steel cost. A reduction in chromium and niobium contents below the specified limits has an adverse effect on steel strength and frost resistance.

Boron introduced within specified range decreases the steel hardening temperatures to 1080° C without impairing its physicomechanical properties.

The steel composition according to the invention increases the yield point and impact toughness, especially in a sub-zero range. It also provides better abrasive resistance and ductility. The steel of the invention also has a fine-grained structure and, its structural and concentration homogeneity is enhanced. At the same time the steel features a higher hardenability and a lower hardening temperature of up to 1080° C.

EXAMPLE 1

A charge comprising high-manganese and carbon steel scrap in a 70:30 ratio is loaded into an electrical furnace.

Upon melting steel is deoxidized whereupon ferromanganese and then ferrochrome are introduced into the melt. During tapping ferroniobium and ferroboron are added into the ladle.

Steel contains the following elements, weight percent:

| | |
|---|---|
| carbon, | 1.15 |
| manganese, | 13 |
| silicon, | 0.8 |
| chromium, | 1.5 |
| niobium, | 0.1 |
| boron, | 0.001, |

the weight percentage of impurities being limited to: sulphur, up to 0.05 and phosphorus, up to 0.06, iron, the rest.

Components produced from this steel show high reliability and longevity.

The steel has proved most advantageous in producing track links for tracked vehicles.

Thus, as shown by experiments, at temperatures of about −50° C the number of track breakages on skidding tractors decreased by 5 times as compared with that for track links in Hadfield steel.

EXAMPLE 2

By using the technology similar to that outlined in Example 1 it is possible to produce steel, comprising (weight percent):

| | |
|---|---|
| carbon, | 1.5 |
| manganese, | 25 |
| silicon, | 1.2 |
| chromium, | 4 |
| niobium, | 0.06 |
| boron, | 0.001, |

the weight percentage of impurities being limited to: sulphur, up to 0.05, phosphorus, up to 0.1, iron, the balance.

Components manufactured from this steel exhibit high wear resistance and strength which makes it possible to extend by 1.5 times the service life of crusher cones and jaws as well as of dredge buckets.

EXAMPLE 3

Using the technology similar to that described in Example 1 steel can be produced, comprising (weight percent:

| | |
|---|---|
| carbon, | 0.8 |
| manganese, | 14 |
| silicon, | 0.3 |
| chromium, | 0.8 |
| niobium, | 0.25 |
| boron, | 0.008, |

the weight percentage of impurities being limited to: sulphur, up to 0.05, phosphorus, up to 0.04, and iron, the rest.

This steel grade is of particular advantage for producing reversible railway frogs because their longevity increases 1.5–2 times.

EXAMPLE 4

By using the production process similar to that outlined in Example 1 it is possible to produce steel, comprising (weight percent):

| | |
|---|---|
| carbon, | 1.3 |
| manganese, | 112 |
| silicon, | 0.5 |
| chromium, | 2 |
| niobium, | 0.15 |
| boron, | 0.002, |

the weight percentage of impurities being limited to: sulphur, up to 0.05, phosphorus, up to 0.06.

Components produced from this steel show a high wear resistance and strength which offers a 2-fold extension in service life of shovel teeth.

What we claim is:

1. A high strength steel capable of being hardened at temperatures of 1080° C. and less, said steel consisting essentially of in, weight percent:

| | |
|---|---|
| manganese, | 9 – 25 |
| silicon, | 0.3 – 1.2 |
| chromium, | 0.8 – 4 |
| niobium, | 0.06 – 0.25 |
| boron, | 0.001 – 0.01, |

the weight percentage of impurities being limited to: sulphur, up to 0.05, phosphorus, up to 0.1 and iron, the balance.

* * * * *

UNITED STATES PATENT OFFICE
CERTIFICATE OF CORRECTION

PATENT NO. : 4,039,328
DATED : August 2, 1977
INVENTOR(S) : Jury Donatovich Novomeisky, et al It is certified that error appears in the above-identified patent and that said Letters Patent are hereby corrected as shown below:

In claim 1, between lines 3 and 4 and below the horizontal line setting forth the range of elements in said steel composition, insert "carbon, 0.8-1.5".

Signed and Sealed this
*Sixteenth* Day of *May 1978*

[SEAL]

*Attest:*

RUTH C. MASON
*Attesting Officer*

LUTRELLE F. PARKER
*Acting Commissioner of Patents and Trademarks*